United States Patent [19]

Martin et al.

[11] Patent Number: 4,784,521

[45] Date of Patent: Nov. 15, 1988

[54] OCEAN DIVERSION WALL

[76] Inventors: David T. Martin, Rte. 3, Box 175 DM, Sherrills Ford, N.C. 28673; George Spector, 233 Broadway, Rm. 3815, New York, N.Y. 10007

[21] Appl. No.: 10,588

[22] Filed: Feb. 3, 1987

[51] Int. Cl.[4] ..... E02B 3/06

[52] U.S. Cl. ..... 405/28; 405/31

[58] Field of Search ..... 405/21, 25, 30, 31, 405/15, 28, 34, 35

[56] References Cited

U.S. PATENT DOCUMENTS

| | | | |
|---|---|---|---|
| 3,490,239 | 1/1970 | Vincent | 405/31 |
| 3,892,075 | 7/1975 | Tibbett | 405/25 X |
| 3,913,333 | 10/1975 | Hubbard | 405/31 |
| 4,407,608 | 10/1983 | Hubbard | 405/31 |
| 4,498,805 | 2/1985 | Weir | 405/31 |

*Primary Examiner*—David H. Corbin

[57] ABSTRACT

An ocean diversion wall is provided to be placed within water for preventing erosion due to wave action. The wall consists of a plurality of off shore facing segments formed as one continuous unit. Each of the segments include a base portion supported on the ocean floor. The base portion has an inclined surface to receive an incoming wave, a curved cup surface to deflect the wave upwardly and a hooked end to turn the wave back onto itself to reduce the force of the wave.

4 Claims, 1 Drawing Sheet

OCEAN DIVERSION WALL

BACKGROUND OF THE INVENTION

The instant invention relates generally to marine breakwater structures and more specifically it relates to an ocean diversion wall.

Numerous marine breakwater structures have been provided in prior art that are adapted to reduce surges of wave water action. For example, U.S. Pat. Nos. 3,490,239; 4,407,608 and 4,498,805 all are of such prior art. While these units may be suitable for the particular purpose to which they address, they would not be as suitable for the purposes of the present invention as heretofore described.

SUMMARY OF THE INVENTION

A primary object of the present invention is to provide an ocean diversion wall that will overcome the shortcomings of the prior art devices.

Another object is to provide an ocean diversion wall that will turn wave water back into itself to slow down its motion thereof.

An additional object is to provide an ocean diversion wall that includes a perforated wall and a pivotable deflector plate placed in front to help decrease the motion of wave water thereagainst.

A further object is to provide an ocean diversion wall that is simple and easy to use.

A still further object is to provide an ocean diversion wall that is economical in cost to manufacture.

Further objects of the invention will appear as the description proceeds.

To the accomplishment of the above and realted objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
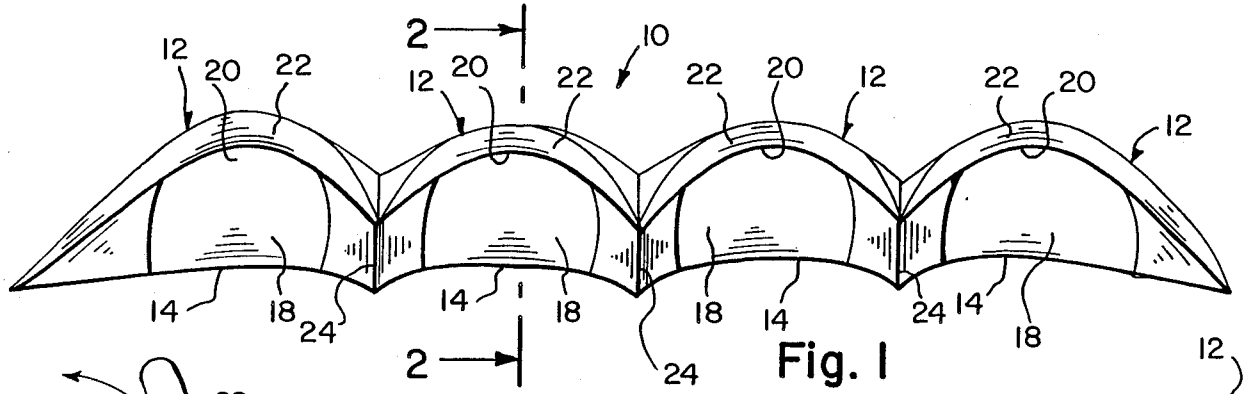
FIG. 1 is a front view of the invention.
Figure 2:
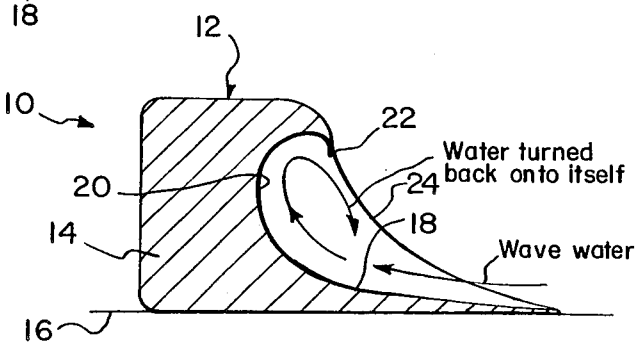
FIG. 2 is a cross sectional view taken along line 2—2 in FIG. 1 showing the curved cup therein.

Turning now descriptively to the drawings, in which similar reference characters denote similar elements throughout the several views, FIGS. 1 and 2 illustrate an ocean diversion wall 10 adapted to be placed within water for preventing erosion due to wave action. The wall 10 consists of a plurality of off shore facing segments 12 formed as one continuous unit. Each of the segments 12 include a base portion 14 supported on the ocean floor 16. The base portion 14 has an inclined surface 18 to receive an incoming wave, a curved cup surface 20 to deflect the wave upwardly and a hooked end 22 to turn the wave back onto itself to reduce the force of the wave.

The diversion wall 10 further contains a plurality of vertically curved edge point portions 24 formed between each of the off shore facing segments 12. Each of the edge point portions 24 cut and brake up the wave when the wave hits thereon.

Figure 3:
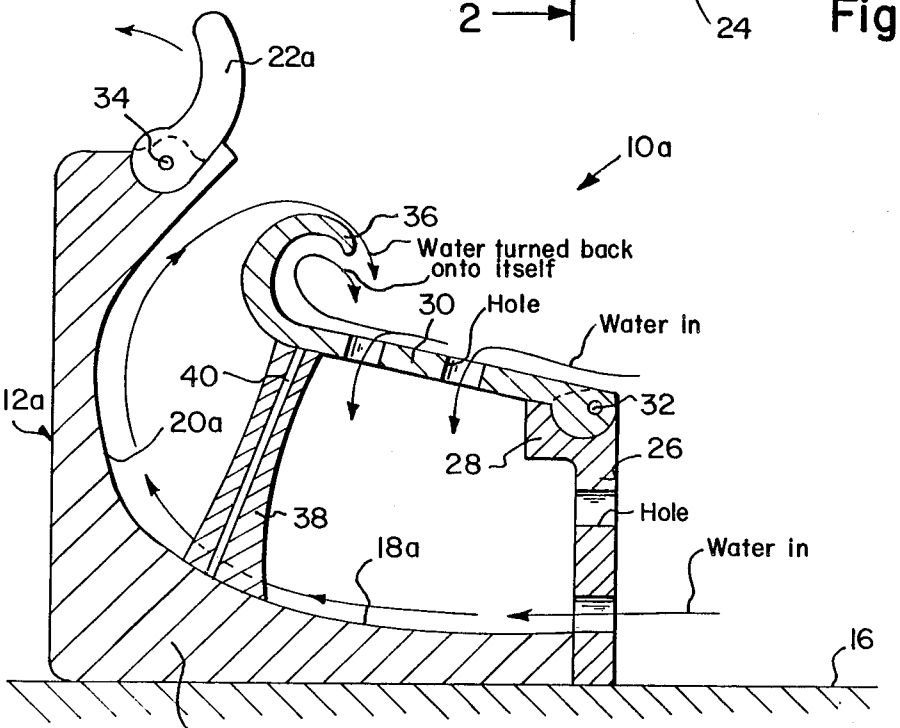
FIG. 3 is a cross sectional view of a modification whereby a perforated wall and a pivotable deflector plate is placed in front.

FIG. 3 shows a modified ocean diversion wall **10*a* that contains a perforated wall 26 that has a seat 28 formed at top thereon. The perforated wall is secured to front of the base portion 14*a* to allow the incoming wave to split up and pass through. The perforated wall 26 is smaller in height than the base portion 14*a*. A perforated deflector plate 30 is pivotable at 32 to the top seat 28 of the perforated wall 26** for relieving upward pressure of the wave.

The hooked end **22*a* on the base portion 14*a* is curved towards an on shore direction and is pivotable thereto at 34. The perforated deflector plate 30 has a hooked end 36 curved towards an off shore direction so as to deflect the wave upwardly and back onto itself to further reduce the force of the wave. A support strut 38 that has a reinforcing rod 40 therein is provided to support. free end of the perforated deflector plate 30** for added structural strength thereto.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An ocean diversion wall adapted to be placed within coastal water for preventing erosion due to wave action, said wall comprising a plurality of off shore facing segments formed as one continuous unit, each of said segments including a base portion supported on the ocean floor, said base portion having a front and rear end, and a curved water receiving surface which extends rearward and upward and terminates in a reverse portion which extends forward to deflect the water towards the incoming waves, further comprising a forward perforated wall secured to said front end of said base portion to allow the incoming wave to pass through, said perforated wall being shorter in height than said rear end of said base portion; a deflector plate pivotably mounted on said perforated wall, extending rearwardly to a point spaced from and lower than said reverse portion, thus defining a channel for water to curve therethrough back towards said waves.

2. An ocean diversion wall as in claim 1, wherein said deflector plate has an upper inclined surface terminating in an upward hooked portion directing water back towards said waves.

3. An ocean diversion wall as recited in claim 2, further comprising a support strut rearward of said forward perforated wall adapted to support said deflector plate when said plate is not lifted by wave action.

4. An ocean diversion wall as in claim 3, wherein a curved hooked end is pivotably mounted on said rear end of said base portion said curved hooked end being curved towards the shore to absorb wave energy.

* * * * *